US009538293B2

(12) United States Patent
Danovi

(10) Patent No.: US 9,538,293 B2
(45) Date of Patent: Jan. 3, 2017

(54) APPARATUS HAVING VARYING GEOMETRY

(71) Applicant: Sonos, Inc., Santa Barbara, CA (US)

(72) Inventor: Benny Danovi, Ventura, CA (US)

(73) Assignee: Sonos, Inc., Santa Barbara, CA (US)

( * ) Notice: Subject to any disclaimer, the term of this patent is extended or adjusted under 35 U.S.C. 154(b) by 170 days.

(21) Appl. No.: 14/448,942

(22) Filed: Jul. 31, 2014

(65) Prior Publication Data

US 2016/0037264 A1 Feb. 4, 2016

(51) Int. Cl.
*H04R 25/00* (2006.01)
*H04R 9/04* (2006.01)

(52) U.S. Cl.
CPC ..... *H04R 9/043* (2013.01)

(58) Field of Classification Search
CPC ..... H04R 9/043; H04R 2307/207; H04R 1/06; H04R 2209/041; H04R 7/18; H04R 7/22; H04R 7/26
USPC .. 381/400–407, 423, 396, 398; 181/171–172
See application file for complete search history.

(56) References Cited

U.S. PATENT DOCUMENTS 5,848,173 A * 12/1998 Sato ..... H04R 7/18 181/171
8,031,896 B2 10/2011 Chick et al.
8,031,897 B2 10/2011 Bastyr et al.
8,189,841 B2 5/2012 Litovsky et al.
8,345,892 B2 1/2013 Jung et al.
8,638,968 B2 1/2014 Gladwin
8,675,899 B2 3/2014 Jung
8,811,648 B2 8/2014 Pance et al.
8,934,657 B2 1/2015 Wilk
2002/0144859 A1* 10/2002 Pocock ..... H04R 7/22 181/172
2007/0223774 A1* 9/2007 Sugiura ..... H04R 7/26 381/407
2012/0121092 A1 5/2012 Starobin
2013/0202149 A1 8/2013 Yoon
2013/0315429 A1 11/2013 Parker et al.

FOREIGN PATENT DOCUMENTS

JP 2011019147 A * 7/2009
JP 2011019147 A * 1/2011

OTHER PUBLICATIONS

Project Ryu Blog, "Project Ryu New Spider Concept Test," [online], 2013 [retrieved Aug. 22, 2014]. Retrieved from the Internet: < URL: http://blog.projectryu.com/project-ryu-new-spider-concept-test/ >.

* cited by examiner

*Primary Examiner* — Davetta W Goins
*Assistant Examiner* — Phylesha Dabney
(74) *Attorney, Agent, or Firm* — McDonnell Boehnen Hulbert & Berghoff LLP

(57) ABSTRACT

Embodiments for a speaker spider of a loudspeaker are provided. The speaker spider may include a central opening and a plurality of concentric corrugations. Dimensions of the speaker spider may substantially homogenize stress on the speaker spiders during operation of the loud speaker. Dimensions of such a speaker spider that substantially homogenizes stress on the speaker spider during operation may involve one or more of (i) corrugations having azimuthally varying depths, (ii) corrugations having azimuthally varying crest and/or trough curvature radii, and (iii) corrugations having angularly varying distances from the central opening of the speaker spider, among other possibilities.

20 Claims, 4 Drawing Sheets

APPARATUS HAVING VARYING GEOMETRY

FIELD OF THE DISCLOSURE

The disclosure is related to consumer goods and, more particularly, to methods, systems, products, features, services, and other elements directed to media playback or some aspect thereof.

BACKGROUND

The term "speaker spider" is used to refer to a mechanism that provides a centering mechanism, in a loudspeaker, to maintain a concentric position of a voice coil relative to a magnetic assembly of the loudspeaker, and a neutral axial position within the loudspeaker. The speaker spider may be under stress during operation of the loudspeaker. Accordingly, a longevity of the loudspeaker may depend on a durability of the speaker spider.

BRIEF DESCRIPTION OF THE DRAWINGS

Features, aspects, and advantages of the presently disclosed technology may be better understood with regard to the following description, appended claims, and accompanying drawings where:

Figure 1:
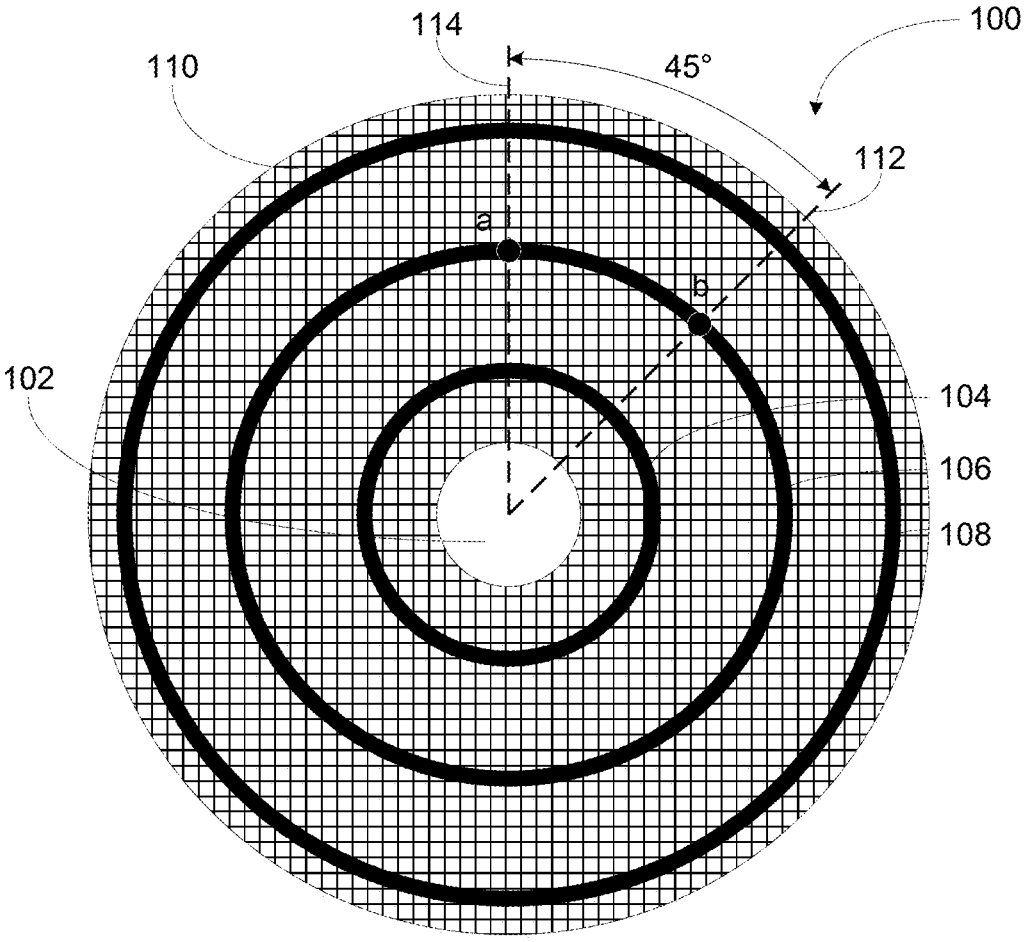
FIG. 1 shows a first illustrative example of a speaker spider.

The drawings are for the purpose of illustrating example embodiments, but it is understood that the inventions are not limited to the arrangements and instrumentality shown in the drawings.

DETAILED DESCRIPTION

I. Overview

Examples described herein involve an apparatus having azimuthally or angularly varying dimensions that help improve homogeneity of stress on the apparatus when the apparatus is under stress. Homogenization of stress on the apparatus may reduce stress in some areas of the apparatus, thereby reducing the chances of cracks or tearing in the apparatus over time. Such an apparatus may have one or more of (i) corrugations having azimuthally varying depths, (ii) corrugations having azimuthally varying crest and/or trough curvatures, and/or (iii) corrugations having angularly varying distances from a central opening of the speaker spider, among other possibilities.

In one example, the apparatus may be implemented as a speaker spider of a loudspeaker. To provide context for such an implementation, some description of speaker spiders are provided in the following paragraphs. In one example, a speaker spider of a loudspeaker may have a central opening that can be coupled to a voice coil of the loudspeaker, and an outer portion that can be coupled to a frame of the loudspeaker. The speaker spider may have a plurality of concentric corrugations that provide a spring-like mechanism to allow movement of the voice coil relative to the loudspeaker frame when the voice coil is driven during operation, while maintaining a concentric position of a voice coil relative to a magnetic assembly of the loudspeaker.

In one case, the speaker spider may be formed from a cloth material. The cloth material may be made of two sets of fabric, interwoven at right angles (i.e., warp and weft). Due to such an interwoven pattern, a stretchability of the cloth material may not be uniform in all directions. As such, if dimensions of the speaker spider are circularly symmetrical and independent of the directions of the interweavings, a flexibility of the speaker spider may vary depending on a direction of an external force.

For instance, the speaker spider may be more flexible in a first direction that is perpendicular (or parallel) to a direction of one of the sets of fabric, and less flexible in a second direction that is 45 degrees from a direction of one of the sets of fabric. As such, during operation of the loudspeaker, a force pulling on the spider in the second direction may generate more stress on the speaker spider than the same force pulling on the spider in the first direction. High stress areas on a speaker spider have may have an increased chance of cracking or tearing, and may be points of failure that compromise the longevity of the speaker spider.

Accordingly, as indicated above, examples described herein involve an apparatus having azimuthally varying dimensions that substantially homogenize stress on the apparatus when the apparatus is under stress. For instance, when the apparatus is implemented as a speaker spider of a loudspeaker, the azimuthally varying dimensions may substantially homogenize stress on the apparatus during operation of the loudspeaker.

In one aspect, an apparatus is provided. The apparatus includes a central opening, and a cloth material. The cloth material includes a plurality of corrugations. For each of the plurality of corrugations, a depth of the corrugation azimuthally varies based on an azimuthal position of the corrugation relative to the central opening.

In another aspect, an apparatus is provided. The apparatus includes a central opening, and a cloth material. The cloth material includes a plurality of corrugations. For each of the plurality of corrugations, a crest curvature of the corrugation azimuthally varies based on an azimuthal position of the corrugation relative to the central opening.

In another aspect, an apparatus is provided. The apparatus includes a central opening, and a cloth material. The cloth material includes a plurality of corrugations. For each of the plurality of corrugations, a distance of the corrugation from the central opening is based on an angular position of the corrugation relative to the central opening.

In another aspect, a loudspeaker is provided. The loudspeaker includes a speaker frame, and a magnetic structure having a central portion. The loudspeaker further includes a voice coil that is magnetically suspended about the central portion, and that is coupled to a speaker cone. The speaker cone is coupled to the speaker frame via a surround. The loudspeaker further includes a speaker spider that couples the voice coil to the speaker frame. The speaker spider includes a central opening, and a cloth material. The cloth material includes a plurality of corrugations. For each of the plurality of corrugations, a depth of the corrugation azimuthally varies based on an azimuthal position of the corrugation relative to the central opening.

In another aspect, a loudspeaker is provided. The loudspeaker includes a speaker frame, and a magnetic structure having a central portion. The loudspeaker further includes a voice coil that is magnetically suspended about the central portion, and that is coupled to a speaker cone. The speaker cone is coupled to the speaker frame via a surround. The loudspeaker further includes a speaker spider that couples the voice coil to the speaker frame. The speaker spider includes a central opening, and a cloth material. The cloth material includes a plurality of corrugations. For each of the plurality of corrugations, a crest curvature of the corrugation azimuthally varies based on an azimuthal position of the corrugation relative to the central opening.

In another aspect, a loudspeaker is provided. The loudspeaker includes a speaker frame, and a magnetic structure having a central portion. The loudspeaker further includes a voice coil that is magnetically suspended about the central portion, and that is coupled to a speaker cone. The speaker cone is coupled to the speaker frame via a surround. The loudspeaker further includes a speaker spider that couples the voice coil to the speaker frame. The speaker spider includes a central opening, and a cloth material. The cloth material includes a plurality of corrugations. For each of the plurality of corrugations, a distance of the corrugation from the central opening is based on an angular position of the corrugation relative to the central opening.

In another aspect, a playback device is provided. The playback device includes a processor, memory, an audio amplifier, a network interface, and at least one speaker. The at least one speaker includes a speaker frame, and a magnetic structure having a central portion. The at least one speaker further includes a voice coil that is magnetically suspended about the central portion, and that is coupled to a speaker cone. The speaker cone is coupled to the speaker frame via a surround. The at least one speaker further includes a speaker spider that couples the voice coil to the speaker frame. The speaker spider includes a central opening, and a cloth material. The cloth material includes a plurality of corrugations. For each of the plurality of corrugations, a depth of the corrugation azimuthally varies based on an azimuthal position of the corrugation relative to the central opening.

In another aspect, a playback device is provided. The playback device includes a processor, memory, an audio amplifier, a network interface, and at least one speaker. The at least one speaker includes a speaker frame, and a magnetic structure having a central portion. The at least one speaker further includes a voice coil that is magnetically suspended about the central portion, and that is coupled to a speaker cone. The speaker cone is coupled to the speaker frame via a surround. The at least one speaker further includes a speaker spider that couples the voice coil to the speaker frame. The speaker spider includes a central opening, and a cloth material. The cloth material includes a plurality of corrugations. For each of the plurality of corrugations, a crest curvature of the corrugation azimuthally varies based on an azimuthal position of the corrugation relative to the central opening.

In another aspect, a playback device is provided. The playback device includes a processor, memory, an audio amplifier, a network interface, and at least one speaker. The at least one speaker includes a speaker frame, and a magnetic structure having a central portion. The at least one speaker further includes a voice coil that is magnetically suspended about the central portion, and that is coupled to a speaker cone. The speaker cone is coupled to the speaker frame via a surround. The at least one speaker further includes a speaker spider that couples the voice coil to the speaker frame. The speaker spider includes a central opening, and a cloth material. The cloth material includes a plurality of corrugations. For each of the plurality of corrugations, a distance of the corrugation from the central opening is based on an angular position of the corrugation relative to the central opening.

While discussions of the apparatus herein may generally be directed to its implementation as a speaker spider, one of ordinary skill in the art will appreciate that the apparatus and variations of the apparatus may also be implemented and/or utilized for other purposes as well.

II. Example Speaker Spiders

FIG. 1 shows a first illustrative example of a speaker spider 100 for a loudspeaker. The speaker spider 100 has a central opening 102, corrugations 104, 106, 108, and an outer portion 110. In an assembly of the loudspeaker, the central opening 102 may be coupled to a voice coil, and the outer portion 110 may be coupled to a frame of the loudspeaker.

During operation of the loudspeaker, a driving force may be applied to the voice coil, to cause the voice coil to move axially in relation to the outer portion 110 that is coupled to the frame of the loudspeaker. The corrugations 104, 106, and 108 may provide a spring-like mechanism to allow movement of the voice coil relative to the loudspeaker frame during operation, while also maintaining a concentric position of a voice coil relative to a magnetic assembly of the loudspeaker. During operation, application of the driving force to the voice coil may result in an external force acting on the speaker spider. The external force may be substantially uniform from all directions.

The speaker spider 100 may be formed from a cloth material that may include one or more of a cotton, poly cotton, or nomex material, among other possibilities. The cloth material may be made of two sets of fabric, interwoven at right angles. In FIG. 1, the grid pattern of the speaker spider 100 may represent the right angled interweavings of the two sets of fabric. As shown, a cross section 114 of the speaker 100 is a cross section of the speaker spider 100 that is parallel (or perpendicular) to a direction of one of the two sets of fabrics, while a cross section 112 of the speaker 11 is a cross section of the speaker spider 100 that is 45 degrees from a direction of one of the two sets of fabrics. The cloth material may be most stretchable along the cross section 114 and least stretchable along the cross section 112.

Figure 2:
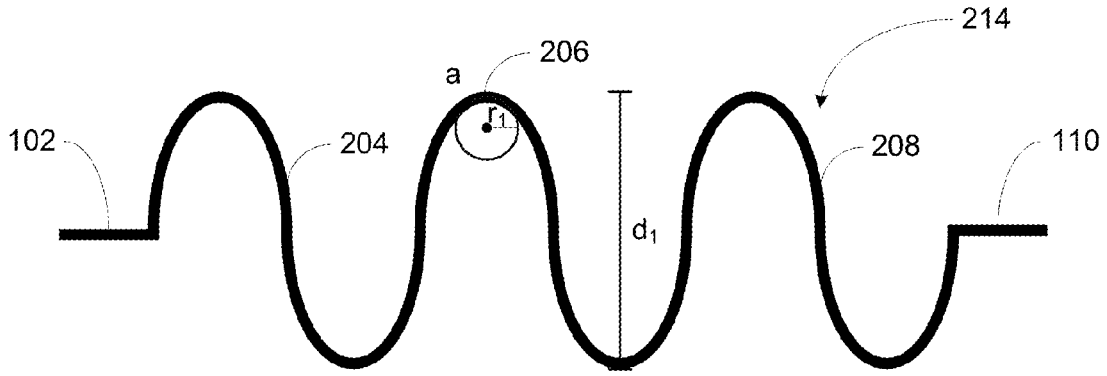
FIG. 2 shows a first illustrative example of a cross section of speaker spider corrugations.

FIG. 2 shows an illustrative cross section 214 of speaker spider corrugations 204, 206, and 208 at the cross section 114 of the speaker spider 100. In other words, the corrugations 204, 206, and 208 may be cross-section representations of the corrugations 104, 106, and 108, respectively, at the cross section 114. As such, point a in FIG. 3A may correspond to point a in FIG. 1.

As shown, each of the corrugations 204, 206, and 208 has a crest and a trough, and a depth between the crest and trough of the respective corrugation. For instance, the depth of the corrugation 206 is $d_1$. Each crest and trough of the corrugations 204, 206, and 208 may also have a respective curvature. For instance, the crest of the corrugation 206 has a curvature with radius $r_1$.

In one case, each of the corrugations 204, 206, and 208 may have the same depth. For instance, the corrugations 204 and 208 may also have depths of $d_1$. In another case, the corrugations 204, 206, and 208 may each have different depths. For instance, the corrugation 208 may have a depth greater than the depth $d_1$ of the corrugation 206, and the corrugation 204 may have a depth less than the depth $d_1$ of corrugation 206.

In one case, the crest curvature and the trough curvature of a corrugation may be the same. For instance, the trough curvature of the corrugation 206 may also have a radius of $r_1$, the same as the crest curvature. In another case, the trough curvature of a corrugation may have a radius bigger or smaller than the crest curvature of the corrugation. For instance, the trough curvature of the corrugation 206 may have a radius that is bigger or smaller than the radius $r_1$ of the crest curvature.

In one case, each of the corrugations 204, 206, and 208 may have the same crest curvature. For instance, the crest curvatures of corrugations 204, 206, and 208 may each have a radius of $r_1$. Similarly, each of the corrugations 204, 206, and 208 may have the same trough curvatures. In another case, each of the corrugations 204, 206, and 208 may have different crest and/or trough curvatures. For instance, the crest and/or trough curvature of the corrugation 204 may have a smaller radius than $r_1$, while the crest and/or trough curvature of the corrugation 208 may have a larger radius than $r_1$. Other examples are also possible.

For simplicity, discussions on the corrugations of the speaker spider 100 hereafter may generally refer to the corrugation 106, the corrugation 206 that is a representation of the corrugation 106, and other representations of the corrugation 106. Nevertheless, one having ordinary skill in the art will appreciate that the discussions may also apply to the corrugations 104 and 204, the corrugations 108 and 208, and other corrugations not necessarily shown in FIGS. 1 and 2.

a. Azimuthally Varying Corrugation Depth

In one example, the corrugation 106 may have a depth that is based on an azimuthal position of the corrugation 106 relative to the central opening 102 of the speaker spider 100. For instance, the corrugation 106 may have a depth that varies azimuthally based on the azimuthal position of the corrugation 106 relative to the central opening 102 of the speaker spider 100.

In one case, the azimuthally varying depth of the corrugation 106 may be at a minimum where an angle between the azimuthal position of the corrugation relative to the central opening 102 and a direction of one of the sets of fabric is 90 degrees. As indicated above, corrugation 206 of the cross section 214 in FIG. 2 is a cross section representation of the corrugation 106 along the cross section 114 that is perpendicular (or parallel) to the direction of one of the sets of fabric. As such, the depth $d_1$ of corrugation 206 may be a minimum depth of the corrugation 106.

Figure 3A:
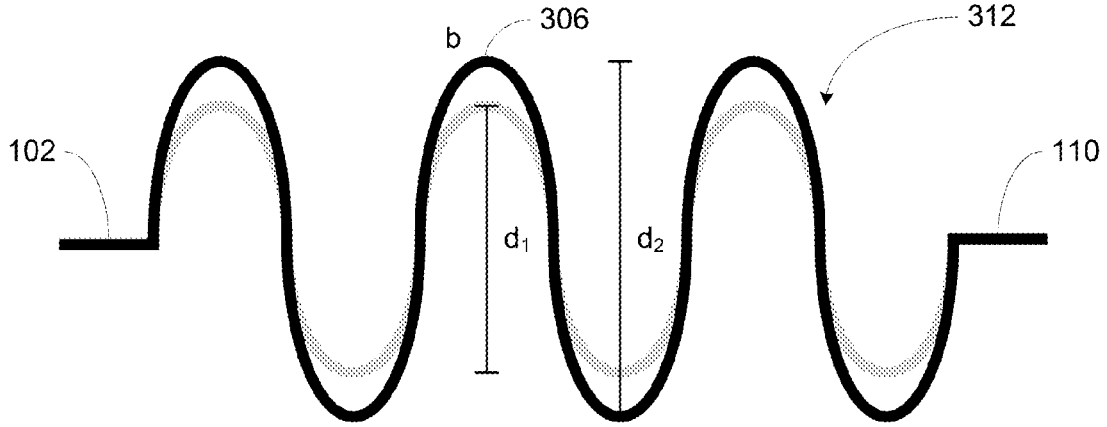
FIG. 3A shows a second illustrative example of a cross section of speaker spider corrugations.

FIG. 3A shows an illustrative cross section 312 of speaker spider corrugations along the cross section 112 of the speaker spider 100. The cross section 312 includes a corrugation 306 that may be a cross-section representation of the corrugation 106 of the speaker spider 100 at the cross section 112. As such, point b in FIG. 3A may correspond to point b in FIG. 1. As shown, the corrugation 306 may have a depth of $d_2$.

In one case, the azimuthally varying depth of the corrugation 106 may be at a maximum where an angle between the azimuthal position of the corrugation 106 relative to the central opening 102 and a direction of one of the sets of fabric is 45 degrees. As indicated above, corrugation 306 of the cross section 312 in FIG. 3A is a cross section representation of the corrugation 106 along the cross section 112 that is 45 degrees from a direction of one of the two sets of fabrics. As such, the depth $d_2$ of corrugation 306 may be a maximum depth of the corrugation 106. For illustrative purposes, FIG. 3A shows the cross section 312 superimposed over a representation of the cross section 214 shown in FIG. 2. As shown, the depth $d_2$ of the corrugation 306 is greater than the depth $d_1$ of the corrugation 206.

In one example, the depth of the corrugation 106 may vary between the minimum depth $d_1$ and the maximum depth $d_2$ along the azimuth of the corrugation 106. As discussed above, the depth of the corrugation 106 may be $d_1$ wherever the angle between the azimuthal position of the corrugation 106 relative to the central opening 102 and a direction of one of the sets of fabric is 90 degrees, and the depth of the corrugation 106 may be $d_2$ wherever the angle between the azimuthal position of the corrugation 106 relative to the central opening 102 and a direction of one of the sets of fabric is 45 degrees.

Using the cross section 114 of the speaker spider 100 as a reference angle, the depth of the corrugation 106 may be $d_1$ at 0 degrees, 90 degrees, 180 degrees, and 270 degrees, and $d_2$ at 45 degrees, 135 degrees, 225 degrees, and 315 degrees. As such, the depth of the corrugation 106 may vary between $d_1$ and $d_2$ at a period of 90 degrees, or $\pi/2$ radians about the central opening 102.

In one example, given that $d_2$ is greater than $d_1$, the speaker spider 100 may have more cloth material along the cross section 112 (as shown in the cross section 312 of FIG. 3A) than along the cross section 114 (as shown in the cross section 214 of FIG. 2). The additional cloth material along the cross section 112 may provide additional flexibility of the speaker spider 100 along the cross section 112, where, as indicated above, the cloth material is otherwise less stretchable. As such, the increased depth $d_2$ of the corrugation 106 along the cross section 112 may, to some extent, neutralize the effects of the reduced cloth material stretchability along the cross section 112 on the flexibility of the speaker spider 100 along the cross section 112.

In one case, depths $d_2$ and $d_1$ may be determined such that the flexibility of the speaker spider 100 along the cross section 112 is substantially the same as the flexibility of the speaker spider 100 along the cross section 114. A ratio between depths $d_2$ and $d_1$ may depend on one or more of the cloth material of the speaker spider, a size of the speaker spider, an intended use of the loud speaker, among other possible factors. In one example, the ratio between the depths $d_2$ and $d_1$ may be in the range of 1.1 to 1.5. Other examples are also possible.

In addition to the maximum depth $d_2$ at the cross section 112 and the minimum depth $d_1$ at the cross section 114, a depth of the corrugation 106 may be determined for any azimuthal position of the corrugation 106 relative to the central opening 102 such that the flexibility of the speaker spider 100 along a cross section of the speaker spider 100 at the particular azimuthal position is substantially the same as that along any other cross section of the speaker spider 100. As with the ratio between the depths $d_2$ and $d_1$, the variation of the corrugation depth between $d_2$ and $d_1$ may depend on one or more of the cloth material of the speaker spider, a size of the speaker spider, an intended use of the loud speaker, among other possible factors. In one case, the depth of the corrugation 106 may vary linearly between $d_1$ and $d_2$ at the period of $\pi/2$ radians. In another case, the depth of the corrugation 106 may vary sinusoidally between $d_1$ and $d_2$ at the period of $\pi/2$ radians. Other examples are also possible.

b. Azimuthally Varying Corrugation Curvature Radius

In another example, the corrugation 106 may have crest and trough curvature radii that are based on an azimuthal position of the corrugation 106 relative to the central opening 102 of the speaker spider 100. For instance, the corrugation 106 may have crest and trough curvature radii that vary azimuthally based on the azimuthal position of the corrugation 106 relative to the central opening 102 of the speaker spider 100.

For simplicity, discussions herein that relate to crest and trough curvature radii may generally refer to a radius of the crest curvature of the corrugation 106. Nevertheless, one having ordinary skill in the art will understand that discussions relating to the crest curvature radius of the corrugation 106 may also be applicable to the trough curvature of the corrugation 106, whether or not the crest curvature and the trough curvature of the corrugation 106 have the same radius. As indicated above, discussions relating to the curvature radii of the corrugation 106 may also be applicable to other corrugations of the speaker spider 100.

In one case, the azimuthally varying radius of the crest curvature of the corrugation 106 may be at a minimum where an angle between the azimuthal position of the corrugation relative to the central opening 102 and a direction of one of the sets of fabric is 90 degrees. As indicated above, corrugation 206 of the cross section 214 in FIG. 2 is a cross section representation of the corrugation 106 along the cross section 114 that is perpendicular (or parallel) to the direction of one of the sets of fabric. As such, the radius $r_1$ of the crest curvature of corrugation 206 may be a minimum crest curvature radius of the corrugation 106.

Figure 3B:
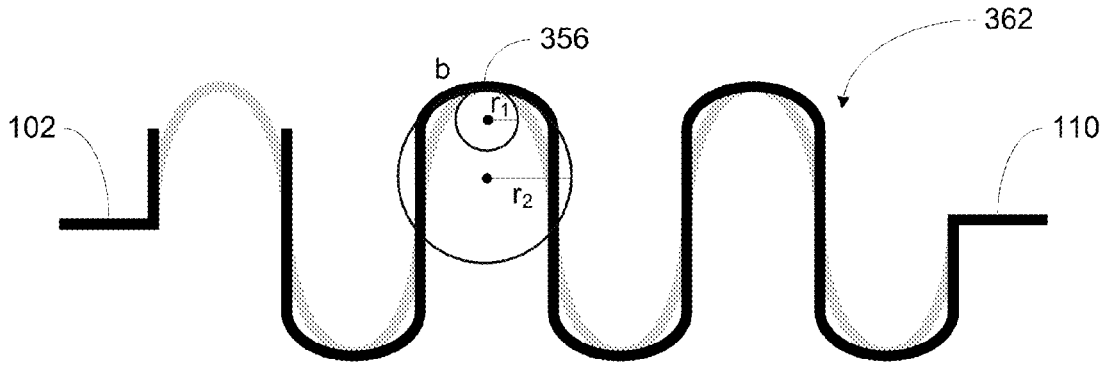
FIG. 3B shows a third illustrative example of a cross section of speaker spider corrugations.

FIG. 3B shows an illustrative cross section 362 of speaker spider corrugations along the cross section 112 of the speaker spider 100. The cross section 362 includes a corrugation 356 that may be a cross-section representation of the corrugation 106 of the speaker spider 100 at the cross section 112. As such, point b in FIG. 3B may also correspond to point b in FIG. 1. As shown, the corrugation 306 may have a crest curvature radius of $r_2$.

In one case, the azimuthally varying crest curvature radius of the corrugation 106 may be at a maximum where an angle between the azimuthal position of the corrugation relative to the central opening 102 and a direction of one of the sets of fabric is 45 degrees. As indicated above, corrugation 356 of the cross section 362 in FIG. 3B is a cross section representation of the corrugation 106 along the cross section 112 that is 45 degrees from a direction of one of the two sets of fabrics. As such, the crest curvature radius $r_2$ of corrugation 306 may be a maximum crest curvature radius of the corrugation 106. For illustrative purposes, FIG. 3B shows the cross section 362 super-imposed over a representation of the cross section 214 shown in FIG. 2. As shown, the crest curvature radius $r_2$ of the corrugation 306 is greater than the crest curvature radius $r_1$ of the corrugation 206.

In one example, the crest curvature radius of the corrugation 106 may vary between the minimum crest curvature radius $r_1$ and the crest curvature radius $r_2$ along the azimuth of the corrugation 106. As discussed above, the crest curvature radius of the corrugation 106 may be $r_1$ wherever the angle between the azimuthal position of the corrugation 106 relative to the central opening 102 and a direction of one of the sets of fabric is 90 degrees, and the crest curvature radius of the corrugation 106 may be $r_2$ wherever the angle between the azimuthal position of the corrugation 106 relative to the central opening 102 and a direction of one of the sets of fabric is 45 degrees.

Using the cross section 114 of the speaker spider 100 as a reference angle, the crest curvature radius of the corrugation 106 may be $r_1$ at 0 degrees, 90 degrees, 180 degrees, and 270 degrees, and $r_2$ at 45 degrees, 135 degrees, 225 degrees, and 315 degrees. As such, the crest curvature radius of the corrugation 106 may vary between $r_1$ and $r_2$ at a period of 90 degrees, or $\pi/2$ radians about the central opening 102.

In one example, given that $r_2$ is greater than $r_1$, the speaker spider 100 may have more cloth material along the cross section 112 (as shown in the cross section 352 of FIG. 3B) than along the cross section 114 (as shown in the cross section 214 of FIG. 2). The additional cloth material along the cross section 112 may provide additional flexibility of the speaker spider 100 along the cross section 112, where, as indicated above, the cloth material is otherwise less stretchable. As such, the increased crest curvature radius $r_2$ of the corrugation 106 along the cross section 112 may, to some extent, neutralize the effects of the reduced cloth material stretchability along the cross section 112 on the flexibility of the speaker spider 100 along the cross section 112.

In one case, crest curvature radii $r_2$ and $r_1$ may be determined such that the flexibility of the speaker spider 100 along the cross section 112 is substantially the same as the flexibility of the speaker spider 100 along the cross section 114. A ratio between crest curvature radii $r_2$ and $r_1$ may depend on one or more of the cloth material of the speaker spider, a size of the speaker spider, an intended use of the loud speaker, among other possible factors. In one example, the ratio between the crest curvature radii $r_2$ and $r_1$ may be in the range of 1.1 to 1.5. Other examples are also possible.

In addition to the maximum crest curvature radius $r_2$ at the cross section 112 and the minimum crest curvature radius $r_1$ at the cross section 114, a corrugation crest curvature radius may be determined for any azimuthal position of the corrugation 106 relative to the central opening 102 such that the flexibility of the speaker spider 100 along a cross section of the speaker spider 100 at the particular azimuthal position is substantially the same as that along any other cross section of the speaker spider 100. As with the ratio between the crest curvature radius $r_2$ and $r_1$, the variation of the corrugation crest curvature radius between $r_2$ and $r_1$ may depend on one or more of the cloth material of the speaker spider, a size of the speaker spider, an intended use of the loud speaker, among other possible factors. In one case, the crest curvature radius of the corrugation 106 may vary linearly between $r_1$ and $r_2$ at the period of $\pi/2$ radians. In another case, the crest curvature radius of the corrugation 106 may vary sinusoidally between $r_1$ and $r_2$ at the period of $\pi/2$ radians. Other examples are also possible.

c. Varying Distance Between Corrugation and Central Opening

Figure 4:
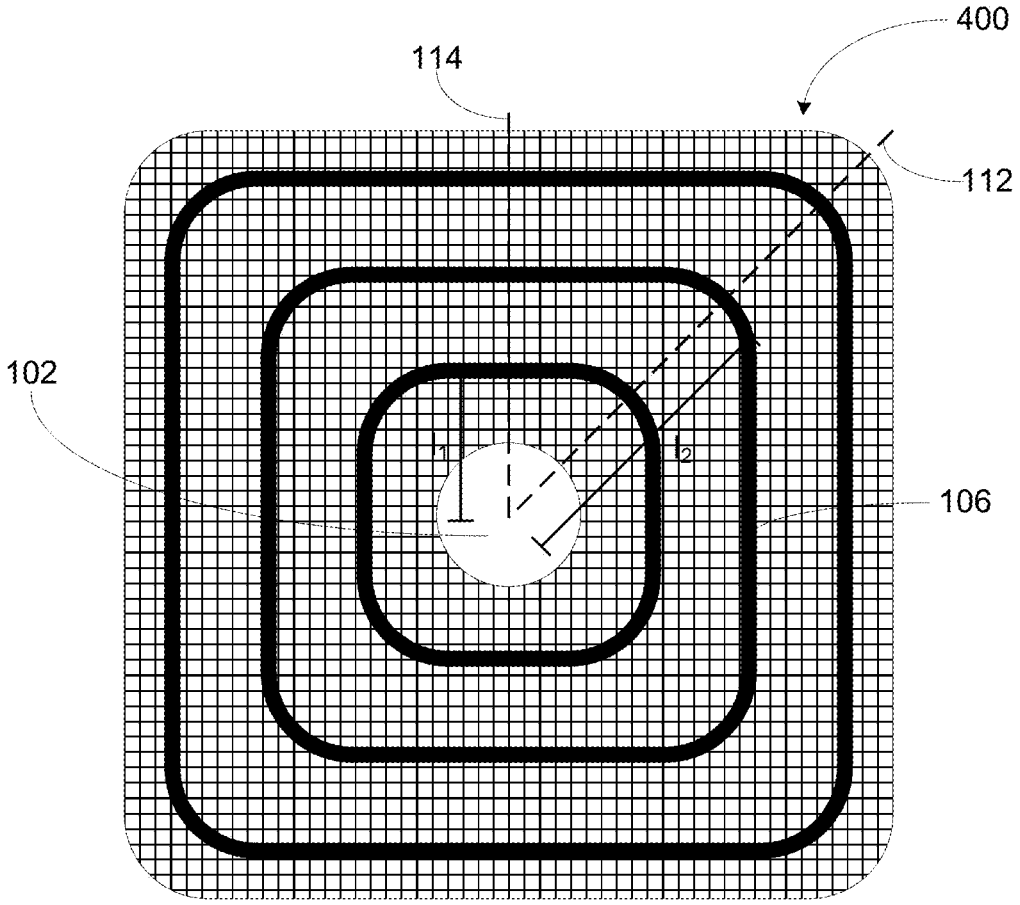
FIG. 4 shows a second illustrative example of a speaker spider.

In a further example, the corrugation 106 may have a distance from the central opening that varies based on an angular position of the corrugation relative to the central opening 102 of the speaker spider 100. FIG. 4 shows an illustrative example of a speaker spider 400. The speaker spider 400 may be a variation of the speaker spider 100, and accordingly, may have the central opening 102, the corrugation 106, and the cross sections 112 and 114, as referenced above. As shown, the corrugation 106 may have an angularly varying distance between the corrugation 106 and the central opening 102.

In one case, the angularly varying distance from the corrugation 106 to the central opening 102 may be at a minimum where an angle between the angular position of the corrugation relative to the central opening 102 and a direction of one of the sets of fabric is 90 degrees. As shown in FIG. 4, the distance between the corrugation 106 and the central opening along the cross section 114 is $1_1$. As indicated above, the cross section 114 is perpendicular (or parallel) to the direction of one of the sets of fabric.

Accordingly, the distance $1_1$ may be a minimum distance between the corrugation 106 and the central opening 102.

In another case, the angularly varying distance from the corrugation 106 to the central opening 102 may be at a maximum where an angle between the angular position of the corrugation relative to the central opening and a direction of one of the sets of fabric is 45 degrees. As shown in FIG. 4, the distance between the corrugation 106 and the central opening along the cross section 112 is $1_2$. As indicated above, the cross section 112 is 45 degrees from a direction of one of the two sets of fabrics. Accordingly, the distance $1_2$ may be a maximum distance between the corrugation 106 and the central opening 102.

For illustration purposes, the distances $1_1$ and $1_2$ are shown to be measured from a center of the central opening 102. Alternatively, the distance between the central opening 102 to the corrugation 106 may be measured from an edge of the central opening 102. Other examples are also possible.

In one example, the distance between the corrugation 106 and the central opening 102 may vary angularly between the distance $1_1$ and the distance $1_2$. As discussed above, the distance between the corrugation 106 and the central opening 102 may be $1_1$ wherever the angle between the position of the corrugation 106 relative to the central opening 102 and a direction of one of the sets of fabric is 90 degrees, and the distance between the corrugation 106 and the central opening 102 may be $1_2$ wherever the angle between the position of the corrugation 106 relative to the central opening 102 and a direction of one of the sets of fabric is 45 degrees.

Using the cross section 114 of the speaker spider 400 as a reference angle, the distance between the corrugation 106 and the central opening 102 may be $1_1$ at 0 degrees, 90 degrees, 180 degrees, and 270 degrees, and $1_2$ at 45 degrees, 135 degrees, 225 degrees, and 315 degrees. As such, the distance between the corrugation 106 and the central opening may vary between $1_1$ and $1_2$ at a period of 90 degrees, or $\pi/2$ radians about the central opening 102.

In one example, given that $1_2$ is greater than $1_1$, the speaker spider 400 may have more cloth material along the cross section 112 than along the cross section 114. The additional cloth material along the cross section 112 may provide additional flexibility of the speaker spider 100 along the cross section 112, where, as indicated above, the cloth material is otherwise less stretchable. As such, the increased distance $1_2$ of the corrugation 106 along the cross section 112 may, to some extent, neutralize the effects of the reduced cloth material stretchability along the cross section 112 on the flexibility of the speaker spider 100 along the cross section 112.

As such, the distances between the corrugation 106 and the central opening 102, $1_2$ and $1_1$ may be determined such that the flexibility of the speaker spider 100 along the cross section 112 is substantially the same as the flexibility of the speaker spider 100 along the cross section 114. A ratio between the distances $1_2$ and $1_1$ may depend on one or more of the cloth material of the speaker spider, a size of the speaker spider, an intended use of the loud speaker, among other possible factors. In one example, the ratio between the distances $1_2$ and $1_1$ may be in the range of 1.1 to 1.5. Other examples are also possible.

In addition to the maximum distance $1_2$ at the cross section 112 and the minimum distance $1_1$ at the cross section 114, a distance between the corrugation 106 and the central opening 102 may be determined for any angular position of the corrugation 106 relative to the central opening 102 such that the flexibility of the speaker spider 400 along a cross section of the speaker spider 400 at the particular angular position is substantially the same as that along any other cross section of the corrugation 106 on the speaker spider 100. As with the ratio between the distances $1_2$ and $1_1$, the variation of the distance between the corrugation 106 and the central opening 102 between $1_2$ and $1_1$ may depend on one or more of the cloth material of the speaker spider, a size of the speaker spider, an intended use of the loud speaker, among other possible factors. In one case, the distance between the corrugation 106 and the central opening may vary linearly between $1_1$ and $1_2$ at the period of $\pi/2$ radians. In another case, the distance between the corrugation 106 and the central opening may vary sinusoidally between $1_1$ and $1_2$ at the period of $\pi/2$ radians. Other examples are also possible.

While the examples described above in sections II.a-II.c are each directed to one of a varying corrugation depth, varying corrugation crest and/or trough curvature radii, or varying distance between the corrugation and the central opening, one having ordinary skill in the art will appreciate that two or more of the examples may be combined to achieve substantially uniform flexibility of the speaker spider 100 along any cross section.

For instance, in one case, each of the depth, crest curvature radii, and trough curvature radii of one or more corrugations of a speaker spider may azimuthally vary based on an azimuthal position of the corrugation relative to the central opening. In another case, the depth and crest curvature radii of one or more corrugations of a speaker spider may azimuthally vary based on an azimuthal position of the corrugation relative to the central opening, while a distance between the corrugation and the central opening also varies based on an angular position of the corrugation relative to the central opening. Other examples are also possible.

Given a suitable one or more of the azimuthally or angularly varying corrugation dimensions discussed above, the flexibility of the speaker spider 100 may be substantially uniform along any cross section. As such, any stress applied to the cloth material when a driving force is applied to the voice coil, and accordingly the speaker spider, may be substantially homogenized. Accordingly, high stress areas and otherwise likely points of failure of the speaker spider may be reduced or eliminated, resulting in a longer, lasting speaker spider.

One having ordinary skill in the art will also appreciate that two or more of the examples described above may be combined to achieve any intended flexibility distribution of any apparatus based on an intended function or implementation of the apparatus.

III. Example Loudspeaker and Media Playback Device

Figure 5:
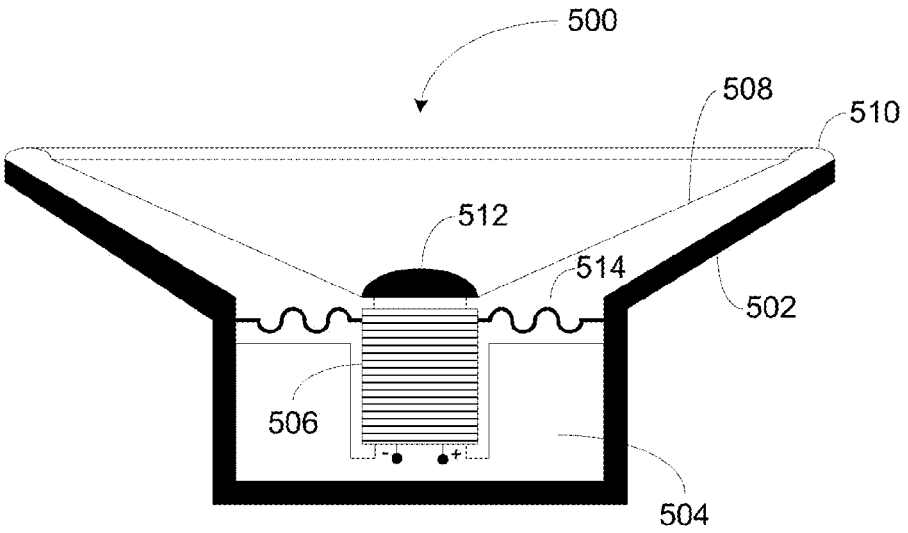
FIG. 5 shows an illustrative example of a loudspeaker.

FIG. 5 shows an illustrative example of a loudspeaker 500, within which an apparatus such that that described above may be implemented as a speaker spider. As shown, the loudspeaker 500 may include a speaker frame (or "basket") 502 and a magnetic structure 504 having a central portion. A voice coil 506 may be magnetically suspended about the center portion of the magnetic structure 504. The voice coil 506, as shown, may have a positive and negative terminal through which electric signals may be provided to drive the voice coil along the center portion of the magnetic structure 504. The voice coil 506 may further be coupled to a speaker cone 508 that is further coupled to the speaker frame 508 via a surround 510. Movement of the speaker cone 508 when the voice coil 506 is driven may cause sound to be produced. A dust cap 512 may cover the voice coil 506 to protect the voice coil 506 from external debris.

As shown in FIG. 500, the loudspeaker 500 also includes a spider 514 coupling the speaker frame 502 to the voice coil 506. As described above, the speaker spider 514 may have a plurality of concentric corrugations that provide a spring-like mechanism to allow movement of the voice coil 506 relative to the speaker frame 502 when the voice coil 506 is driven during operation, while maintaining a concentric position of a voice coil relative to a magnetic assembly of the loudspeaker. In one example, an apparatus such as those described above in section II.a-II.c may be implemented as the speaker spider 514 of the loudspeaker 500 shown in FIG. 5. The loudspeaker 500 may be coupled to an audio amplifier from which an audio signal to be rendered by the loudspeaker 500 may be received. Other examples are also possible.

Figure 6:
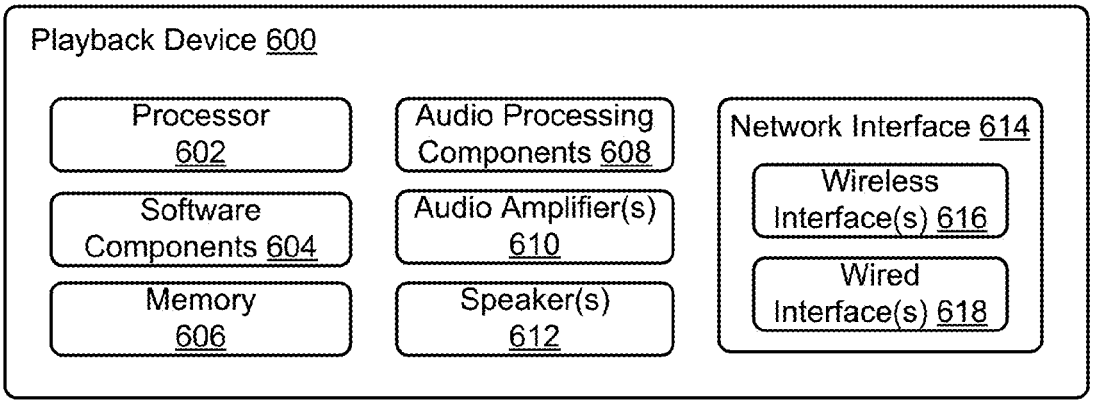
FIG. 6 shows a functional block diagram of a playback device.

FIG. 6 shows a functional block diagram of a playback device 600. The playback device 600 may include a processor 602, software components 604, memory 606, audio processing components 608, audio amplifier(s) 610, speaker(s) 612, and a network interface 614 including wireless interface(s) 616 and wired interface(s) 618. The speaker(s) 612 may include one or more of the speaker discussed in connection to and shown in FIG. 5. As such, an apparatus such as those described above in second II.a-II.c. may be implemented as a speaker spider for the speaker(s) 612.

In one example, the processor 602 may be a clock-driven computing component configured to process input data according to instructions stored in the memory 606. The memory 606 may be a tangible computer-readable medium configured to store instructions executable by the processor 602. For instance, the memory 606 may be data storage that can be loaded with one or more of the software components 604 executable by the processor 602 to achieve certain functions. In one example, the functions may involve the playback device 600 retrieving audio data from an audio source or another playback device. In another example, the functions may involve the playback device 600 sending audio data to another device or playback device on a network. In yet another example, the functions may involve pairing of the playback device 600 with one or more playback devices to create a multi-channel audio environment.

Certain functions may involve the playback device 600 synchronizing playback of audio content with one or more other playback devices. During synchronous playback, a listener will preferably not be able to perceive time-delay differences between playback of the audio content by the playback device 600 and the one or more other playback devices. U.S. Pat. No. 8,234,395 entitled, "System and method for synchronizing operations among a plurality of independently clocked digital data processing devices," which is hereby incorporated by reference, provides in more detail some examples for audio playback synchronization among playback devices.

The memory 606 may further be configured to store data associated with the playback device 600, such as one or more zones and/or zone groups the playback device 600 is a part of, audio sources accessible by the playback device 600, or a playback queue that the playback device 600 (or some other playback device) may be associated with. The data may be stored as one or more state variables that are periodically updated and used to describe the state of the playback device 600. The memory 606 may also include the data associated with the state of the other devices of the media system, and shared from time to time among the devices so that one or more of the devices have the most recent data associated with the system. Other embodiments are also possible.

The audio processing components 608 may include one or more digital-to-analog converters (DAC), an audio preprocessing component, an audio enhancement component or a digital signal processor (DSP), and so on. In one embodiment, one or more of the audio processing components 608 may be a subcomponent of the processor 602. In one example, audio content may be processed and/or intentionally altered by the audio processing components 608 to produce audio signals. The produced audio signals may then be provided to the audio amplifier(s) 610 for amplification and playback through speaker(s) 612. Particularly, the audio amplifier(s) 610 may include devices configured to amplify audio signals to a level for driving one or more of the speakers 612. The speaker(s) 612 may include an individual transducer (e.g., a "driver") or a complete speaker system involving an enclosure with one or more drivers. A particular driver of the speaker(s) 612 may include, for example, a subwoofer (e.g., for low frequencies), a mid-range driver (e.g., for middle frequencies), and/or a tweeter (e.g., for high frequencies). In some cases, each transducer in the one or more speakers 612 may be driven by an individual corresponding audio amplifier of the audio amplifier(s) 610. In addition to producing analog signals for playback by the playback device 600, the audio processing components 608 may be configured to process audio content to be sent to one or more other playback devices for playback.

Audio content to be processed and/or played back by the playback device 600 may be received from an external source, such as via an audio line-in input connection (e.g., an auto-detecting 3.5 mm audio line-in connection) or the network interface 614.

The network interface 614 may be configured to facilitate a data flow between the playback device 600 and one or more other devices on a data network. As such, the playback device 600 may be configured to receive audio content over the data network from one or more other playback devices in communication with the playback device 600, network devices within a local area network, or audio content sources over a wide area network such as the Internet. In one example, the audio content and other signals transmitted and received by the playback device 600 may be transmitted in the form of digital packet data containing an Internet Protocol (IP)-based source address and IP-based destination addresses. In such a case, the network interface 614 may be configured to parse the digital packet data such that the data destined for the playback device 600 is properly received and processed by the playback device 600.

As shown, the network interface 614 may include wireless interface(s) 616 and wired interface(s) 618. The wireless interface(s) 616 may provide network interface functions for the playback device 600 to wirelessly communicate with other devices (e.g., other playback device(s), speaker(s), receiver(s), network device(s), control device(s) within a data network the playback device 600 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 618 may provide network interface functions for the playback device 600 to communicate over a wired connection with other devices in accordance with a communication protocol (e.g., IEEE 802.3). While the network interface 614 shown in FIG. 6 includes both wireless interface(s) 616 and wired interface(s) 618, the network interface 614 may in some embodiments include only wireless interface(s) or only wired interface(s).

In one example, the playback device 600 and one other playback device may be paired to play two separate audio components of audio content. For instance, playback device 600 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 600 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 600 is a playback device designed to render low frequency range audio content (i.e. a subwoofer), the playback device 600 may be consolidated with a playback device designed to render full frequency range audio content. In such a case, the full frequency range playback device, when consolidated with the low frequency playback device 600, may be configured to render only the mid and high frequency components of audio content, while the low frequency range playback device 600 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CONNECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use. Other examples are also possible.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

I claim:

1. A speaker assembly comprising:

a voice coil; and a flexible speaker spider coupled to the voice coil to allow movement of the voice coil relative to a speaker frame while maintaining position of the voice coil relative to a magnetic assembly when the voice coil is driven, the speaker spider comprising:

a central opening; and a cloth material that is more flexible along a first set of angular positions relative to the central opening than along a second set of angular positions relative to the central opening, wherein the cloth material comprising a plurality of corrugations, and wherein a depth of each corrugation azimuthally varies based on an angular position relative to the central opening such that a minimal depth of each corrugation is at the first set of angular positions relative to the central opening, and a maximal depth of each corrugation is at the second set of angular positions relative to the central opening.

2. The speaker assembly of claim 1, wherein the depth of each corrugation azimuthally varies between the minimum depth and the maximum depth, and wherein the maximum depth is greater than the minimum depth by a factor within a range of 1.1 to 1.5.

3. The speaker assembly of claim 1, wherein the depth of each corrugation azimuthally varies linearly between the minimum depth and the maximum depth at a period of n/2 radians about the central opening.

4. The speaker assembly of claim 1, wherein the depth of each corrugation azimuthally varies sinusoidally between the minimum depth and the maximum depth at a period of n/2radians about the central opening.

5. The speaker assembly of claim 1, wherein the cloth material comprises two sets of fabric interwoven at right angles, and wherein the depth of each corrugation is at the minimum depth where an angle between the azimuthal position of each corrugation relative to the central opening and a direction of one of the sets of fabric is 90 degrees.

6. The speaker assembly of claim 1, wherein the cloth material comprises two sets of fabric interwoven at right angles, and wherein the depth of each corrugation is at the maximum where an angle between the azimuthal position of each corrugation relative to the central opening and a direction of one of the sets of fabric is 45 degrees.

7. The speaker assembly of claim 1, wherein the cloth material comprises one or more of cotton, poly cotton, and nomex.

8. The speaker assembly of claim 1, wherein the azimuthally varying depth of each corrugation substantially homogenizes a stress on the cloth material when a driving force is applied to the speaker spider.

9. A speaker assembly comprising:

a voice coil; and a flexible speaker spider coupled to the voice coil to allow movement of the voice coil relative to a speaker frame while maintaining position of the voice coil relative to a magnetic assembly when the voice coil is driven, the speaker spider comprising:

a central opening; and a cloth material that is more flexible along a first set of angular positions relative to the central opening than along a second set of angular positions relative to the central opening, wherein the cloth material comprising a plurality of corrugations, and wherein a crest curvature radius of the corrugation azimuthally varies based on an angular position relative to the central opening such that a minimal crest curvature radius of each corrugation is at the first set of angular positions relative to the central opening, and a maximal crest curvature radius of each corrugation is at the second set of angular positions relative to the central opening.

10. The speaker assembly of claim 9, wherein the crest curvature radius of each corrugation azimuthally varies between the minimum crest curvature and the maximum crest curvature, and wherein the maximum crest curvature radius is greater than the minimum crest curvature radius by a factor within a range of 1.1 to 1.5.

11. The speaker assembly of claim 9, wherein the crest curvature radius of each corrugation azimuthally varies linearly between the minimum crest curvature radius and the maximum crest curvature radius at a period of n/2 radians about the central opening.

12. The speaker assembly of claim 9, wherein the crest curvature radius of the corrugation azimuthally varies sinusoidally between the minimum crest curvature radius and the maximum crest curvature radius at a period of n/2 radians about the central opening.

13. The speaker assembly of claim 9, wherein the cloth material comprises two sets of fabric interwoven at right angles, and wherein the crest curvature radius of each corrugation is at the minimum crest curvature radius where an angle between the azimuthal position of each corrugation relative to the central opening and a direction of one of the sets of fabric is 90 degrees.

14. The speaker assembly of claim 9, wherein the cloth material comprises two sets of fabric interwoven at right angles, and wherein the crest curvature radius of each corrugation is at the maximum depth where an angle between the azimuthal position of the corrugation relative to the central opening and a direction of one of the sets of fabric is 45 degrees.

15. The speaker assembly of claim 9, wherein the cloth material comprises one or more of cotton, poly cotton, and nomex.

16. The speaker assembly of claim 9, wherein the azimuthally varying crest curvature of each corrugation substantially homogenizes a stress on the cloth material when a driving force is applied to the speaker spider.

17. A speaker assembly comprising:

a voice coil; and a flexible speaker spider coupled to the voice coil to allow movement of the voice coil relative to a speaker frame while maintaining position of the voice coil relative to a magnetic assembly when the voice coil is driven, the speaker spider comprising:

a central opening; and a cloth material that is more flexible along a first set of angular positions relative to the central opening than along a second set of angular positions relative to the central opening, wherein the cloth material comprising a plurality of corrugations, and wherein a distance of the corrugation from the central opening varies based on an angular position relative to the central opening such that a minimal distance of each corrugation from the central opening is at the first set of angular positions relative to the central opening, and a maximal distance of each corrugation from the central opening is at the second set of angular positions relative to the central opening.

18. The speaker assembly of claim 17, wherein the distance of each corrugation from the central opening varies between the minimum distance and the maximum distance, and wherein the maximum distance is greater than the minimum distance by a factor within a range of 1.1 to 1.5.

19. The speaker assembly of claim 17, wherein the distance of each corrugation from the central opening varies between the minimum distance and the maximum distance at a period of n/2 radians about the central opening.

20. The speaker assembly of claim 17, wherein the cloth material comprises two sets of fabric interwoven at right angles, and wherein the distance of each corrugation from the central opening is at the maximum where an angle between the angular position of the corrugation relative to the central opening and a direction of one of the sets of fabric is 45 degrees.

* * * * *